United States Patent [19]

Schultze et al.

[11] Patent Number: 4,850,808

[45] Date of Patent: Jul. 25, 1989

[54] LIQUID RING PUMP HAVING PORT MEMBER WITH INTERNAL PASSAGEWAYS FOR HANDLING CARRY-OVER GAS

[75] Inventors: Walter J. Schultze, Trumbull; Ole B. Olsen, Newtown, both of Conn.

[73] Assignee: The Nash Engineering Company, Norwalk, Conn.

[21] Appl. No.: 713,488

[22] Filed: Mar. 19, 1985

[51] Int. Cl.[4] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,322,363 | 11/1919 | Siemen et al. | 417/68 |
| 2,195,174 | 3/1940 | Jennings | 417/68 |
| 3,721,508 | 3/1973 | Mugele | 417/68 |
| 4,083,658 | 4/1978 | Ramm | 417/68 |
| 4,521,161 | 6/1985 | Olsen et al. | 417/68 |

FOREIGN PATENT DOCUMENTS

| | | | |
|---|---|---|---|
| 258483 | 4/1913 | Fed. Rep. of Germany | 417/68 |
| 258854 | 4/1913 | Fed. Rep. of Germany | 417/68 |
| 40260 | 3/1913 | Sweden | 417/68 |
| 914809 | 3/1982 | U.S.S.R. | 417/68 |

*Primary Examiner*—Carlton R. Croyle
*Assistant Examiner*—Eugene L. Szczecina, Jr.
*Attorney, Agent, or Firm*—Robert R. Jackson

[57] ABSTRACT

In a conically or cylindrically ported liquid ring pump, compressed gas that would otherwise be carried over from the compression zone to the intake zone of the pump is made to bypass the intake zone by passing through a first aperture in the port member into a clearance between the rotor shaft and the port member and then through a second aperture in the port member from the clearance to an initial portion of the compression zone.

20 Claims, 6 Drawing Sheets

12
14
16
18
20
22
24
28
30
32
34
36
38
40
48
50
52
54
64
68
70
72
80
82
86
88
90
94
98
100
104
108
110
150
2
6

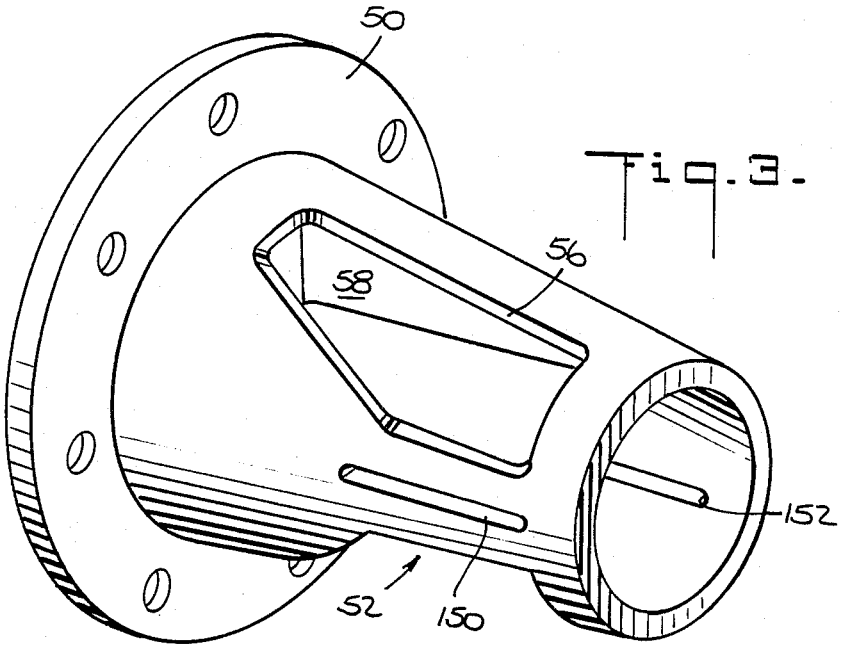
Fig. 3.
Fig. 4.
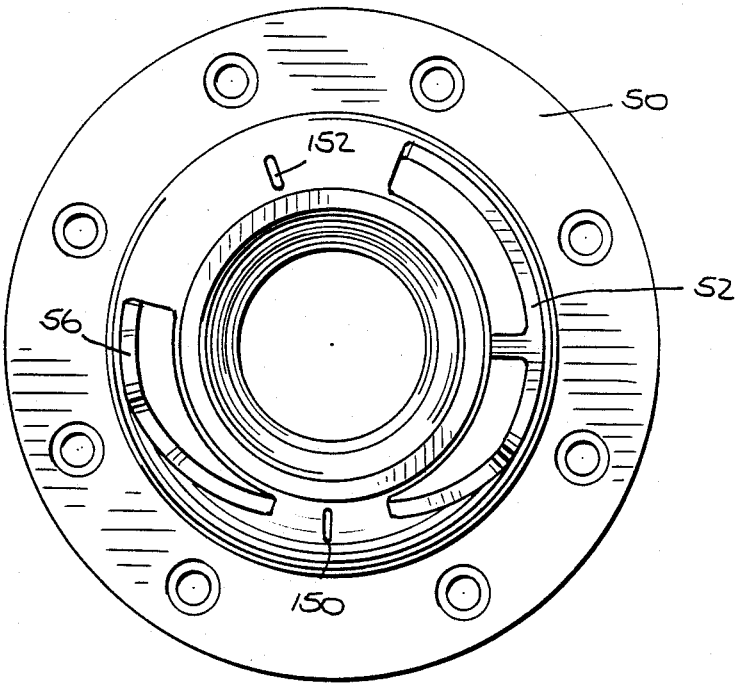

12
14
16
18
20
22
24
28
30
32
34
36
38
40
48
50
52
54
60
64
70
72
80
82
88
90
94
98
100
104
108
110
150
200
202
204

LIQUID RING PUMP HAVING PORT MEMBER WITH INTERNAL PASSAGEWAYS FOR HANDLING CARRY-OVER GAS

BACKGROUND OF THE INVENTION

This invention relates to liquid ring gas pumps, and more particularly to liquid ring gas pumps including means for reducing the amount of gas which is carried over from the compression zone of the pump to the intake zone of the pump.

As shown in German Pat. No. 258,483, it is known that the performance of liquid ring gas pumps can be improved by providing a conduit for causing gas that would otherwise be carried over from the compression zone to the intake zone ("carry-over gas") to bypass the intake zone. To be effective, however, such conduits must be large enough to convey carry-over gas with minimum loss of pressure. Such additional, adequately sized conduits have proven difficult or impossible to incorporate in liquid ring pumps having conical or cylindrical port members. Furthermore, even undersized conduits may significantly increase the complexity and cost of such pumps.

It is therefore an object of this invention to simplify the manner in which carry-over gas is handled in liquid ring pumps having conical or cylindrical port members.

SUMMARY OF THE INVENTION

This and other objects of the invention are accomplished in accordance with the principles of the invention by providing, in a conically or cylindrically ported liquid ring gas pump, a first aperture through the port member of the pump which allows what would otherwise be carry-over gas to enter a clearance between the port member and the rotor shaft. A second aperture through the port member allows the gas in the above-mentioned clearance to re-enter the pumping chambers of the pump beyond the intake zone in the direction of rotor rotation.

Further features of the invention, its nature and various advantages will be more apparent from the accompanying drawings and the following detailed description of the invention.

BRIEF DESCRIPTION OF THE DRAWINGS

FIG. 3 is a perspective view of the first stage port member of the pump of FIGS. 1 and 2.

FIG. 4 is an end view of the port member of FIG. 3.

DETAILED DESCRIPTION OF THE INVENTION

Figure 1:
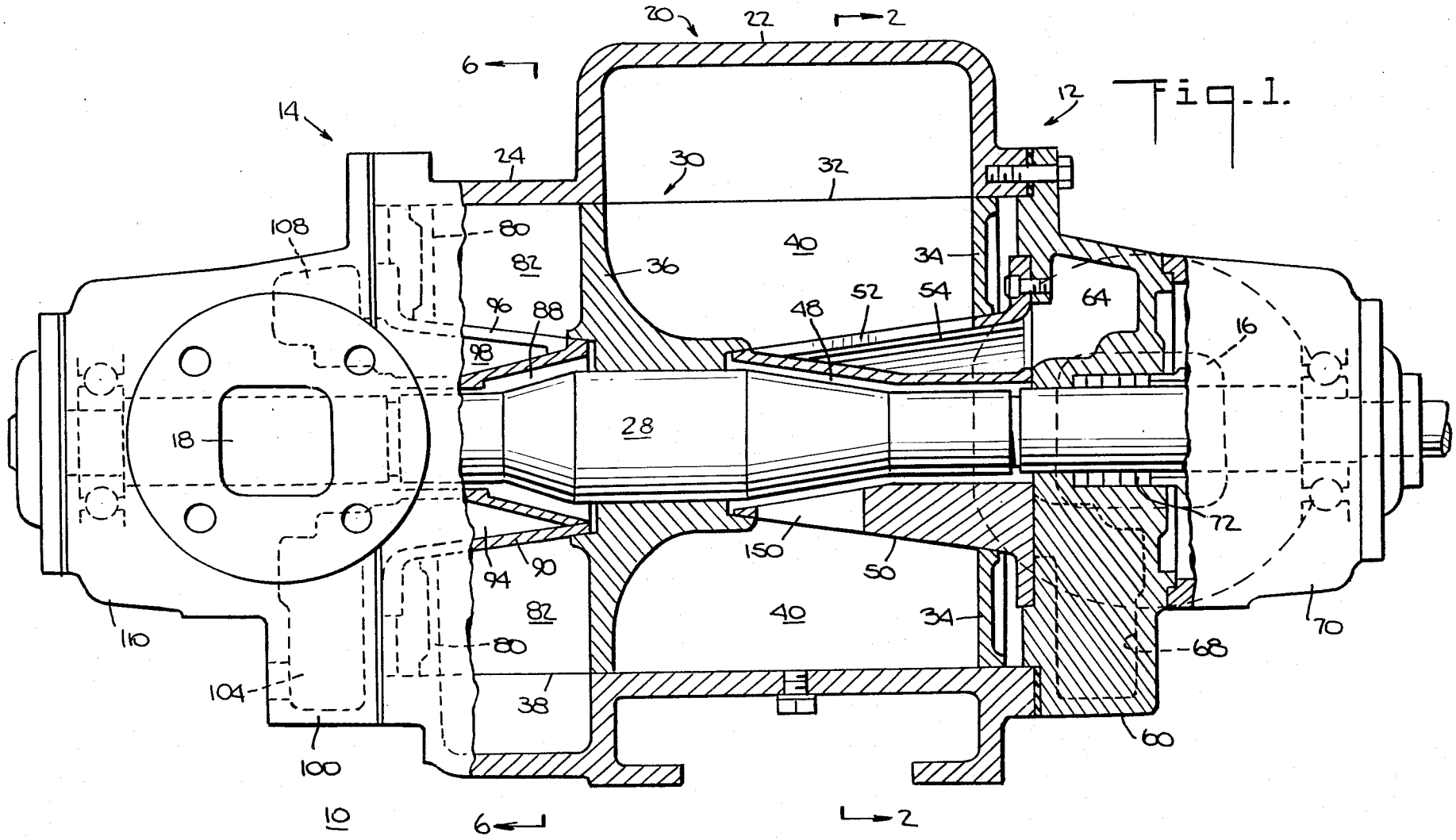
FIG. 1 is a partly sectional, elevational view of a conically ported, two-stage liquid ring pump constructed in accordance with the principles of the invention. The sectional portion of FIG. 1 is taken along the line 1—1 in FIGS. 2 and 6.
Figure 2:
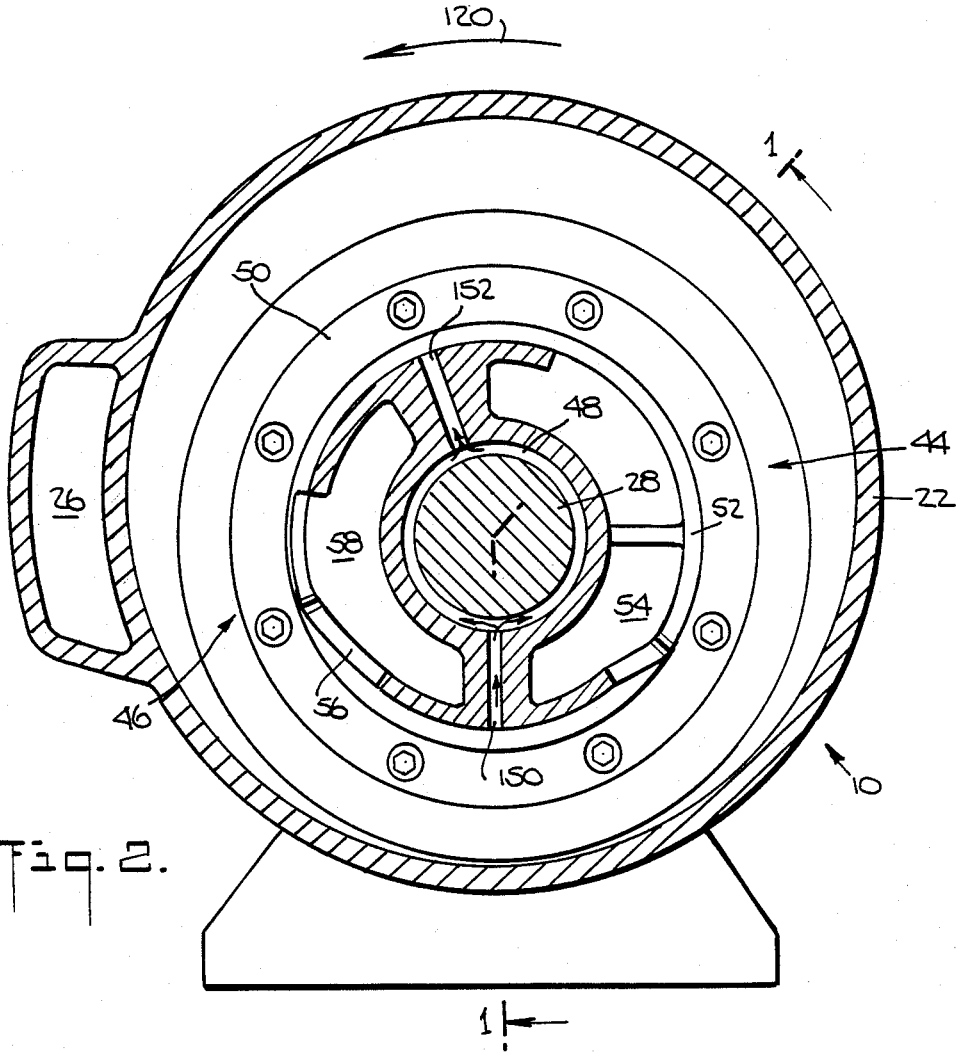
FIG. 2 is a cross-sectional view taken along the line 2—2 in FIG. 1 with the rotor removed.
Figure 5:
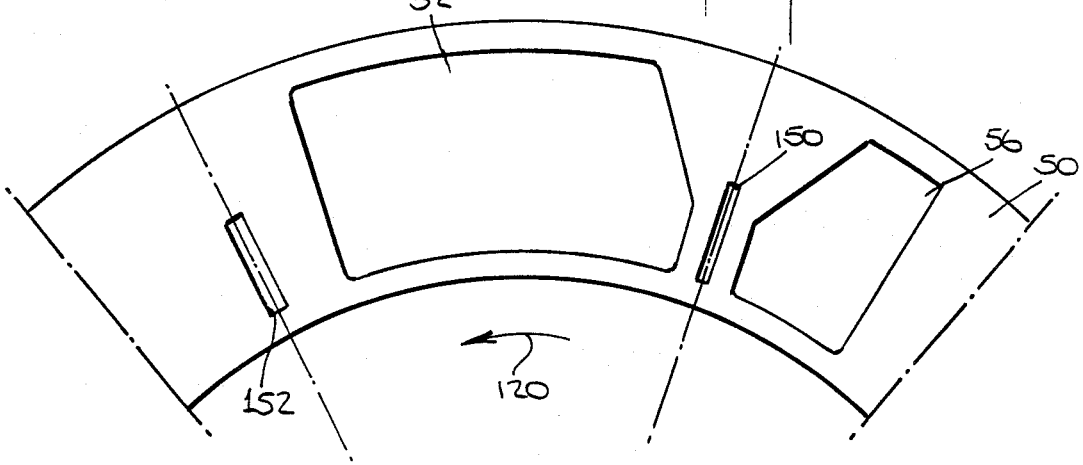
FIG. 5 is a planar projection of the outer surface of the port member of FIGS. 3 and 4.

The liquid ring pump 10 shown in FIGS. 1-6 is a two-stage, conically ported pump having a first stage 12 on the right in FIG. 1 and a second stage 14 on the left in that FIG. Gas or vapor to be pumped (hereinafter generically referred to as gas) enters the pump via inlet opening 16 and, after successively passing through the first and second stages, exits from the pump via outlet opening 18.

The pump has a generally annular housing 20 including a first stage portion 22 and a second stage portion 24. Rotatably mounted in housing 20 is a shaft 28 and a rotor 30 fixedly mounted on the shaft. Rotor 30 has a first stage portion 32 extending from annular end shroud 34 to annular interstage shroud 36. Rotor 30 also has a second stage partion 38 extending from interstage shroud 36 to annular end shround 80. Circumferentially spaced, radially extending, first stage rotor blades 40 extend from interstage shround 36 to end shroud 34. Circumferentially spaced, radially extending, second stage rotor blades 82 extend from interstage shroud 36 to end shround 80.

Adjacent to end shround 34, rotor 30 has a first frusto-conical bore concentric with shaft 28. Frusto-conical first stage port member 50 extends into this bore between shaft 28 and rotor 30. (Although port member 50 is actually frusto-conical, those skilled in the art generally refer to such port members as conical, and that terminology is sometimes employed herein.) It should be noted that there is a substantial annular clearance 48 between shaft 28 and the innermost surface of port member 50. Port member 50 is fixedly connected to first stage head member 60, which is in turn fixedly connected to housing 20. Bearing assembly 70 is fixedly connected to head member 60 for rotatably supporting shaft 28 adjacent the first stage end of the pump. Stuffing assembly 72 is provided in head member 60 to substantially prevent gas or liquid leakage where shaft 28 enters first stage housing portion 22.

Adjacent to end shroud 80 a second frustoconical port member 90 extends into a second frustoconical bore in rotor 30. Port member 90 is concentric with shaft 28 and is fixedly mounted on second stage head member 100, which is in turn fixedly mounted on housing 20. There is another substantial annular clearance 88 between shaft 28 and the innermost surface of port member 90. Annular clearances 48 and 88 are isolated from one another by the core of rotor 30 which fits tightly on shaft 28. Bearing assembly 110 is fixedly mounted on head member 100 for rotatably supporting shaft 28 adjacent the second stage end of the pump. Another stuffing assembly (not shown but similar to stuffing assembly 72) is provided in head member 100 to substantially prevent gas or liquid leakage where shaft 28 enters second stage housing portion 24.

First stage housing portion 22 is eccentric to first stage rotor portion 32, and second stage housing portion 24 is similarly (but oppositely) eccentric to second stage rotor portion 38. Both portions of housing 20 are partially filled with pumping liquid (usually water) so that when rotor 30 is rotated in the direction of arrow 120, the rotor blades engage the pumping liquid and cause it to form an eccentric ring of recirculating liquid in each of the two stages of the pump. In each stage of the pump this liquid cyclically diverges from and then converges toward shaft 28 as rotor 30 rotates. Where the liquid is diverging from the shaft, the resulting reduced pressure in the spaces between adjacent rotor blades constitutes a gas intake zone 44 or 84. Where the liquid is converging toward the shaft, the resulting increased pressure in the spaces between adjacent rotor blades constitutes a gas compresssion zone 46 or 86.

First stage port member 50 includes an inlet port 52 for admitting gas to first stage intake zone 44. Port member 50 also includes a discharge port 56 for allowing compressed gas to exit from first stage compression zone 46. Gas is conveyed from inlet opening 16 to inlet port 52 via conduit 64 in head member 60 and conduit 54 in port member 50. Gas discharged via discharge port 56 is conveyed via conduit 58 in port member 50 and conduit 68 in head member 60. This gas is conveyed from first stage head member 60 to second stage head member 100 via interstage conduit 26 (FIG. 2) which is formed as part of housing 20.

Second stage port member 90 includes an inlet port 92 (FIG. 6) for admitting gas to second stage intake zone 84, and a discharge port 96 for allowing gas to exit from second stage compression zone 86. Gas is conveyed from interstage conduit 26 to the second stage inlet port via conduit 104 in head member 100 and conduit 94 in port member 90. Gas discharged via second stage discharge port 96 is conveyed to outlet opening 18 via conduit 98 in port member 90 and conduit 108 in head member 100.

As is conventional in two-stage liquid ring pumps, the first stage discharge pressure (which is approximately equal to the second stage intake pressure) is substantially greater than the first stage intake pressure, and the second stage discharge pressure is substantially greater than the second stage intake pressure. For example, in a typical vacuum pump installation, the first stage intake pressure is near zero absolute pressure, the second stage discharge pressure is atmospheric pressure, and the interstage pressure (i.e., the first stage discharge and second stage intake pressure) is intermediate these other pressures.

It is known that it is difficult to completely purge compression zones 46 and 86 of gas via dicharge ports 56 and 96, and that some gas is therefore typically carried over from each compression zone to the associated intake zone 44 or 84. This is an inefficiency in the operation of the pump. The energy required to compress the carry-over gas is largely wasted when the carry-over gas re-expands in the intake zone. In addition, the carry-over gas reduces both the volumetric capacity of the pump and the maximum compression ratio (measured between openings 16 and 18) attainable by the pump.

In accordance with the present invention, two radial apertures 150 and 152 are provided through port member 50 to allow gas that would otherwise be carried over from compression zone 46 to intake zone 44 to bypass intake zone 44 and re-enter compression zone 46. Aperture 150 passes through port member 50 at a point beyond the closing edge of discharge port 56 but before the leading edge of intake port 52 in the direction of rotor rotation. Aperture 150 extends radially all the way through port member 50 to the annular clearance 48 between shaft 28 and the innermost surface of port member 50. Aperture 152 passes through port member 50 at a point beyond the closing edge of intake port 52 but before the leading edge of discharge port 56 in the direction of rotor rotation. Like aperture 150, aperture 152 extends radially all the way through port member 50 to annular clearance 48. Accordingly, compressed gas that would otherwise be carried over from compression zone 46 to intake zone 44 flows instead through aperture 150 into annular clearance 48. From clearance 48 this gas flows through aperture 152 into the intial portion of compression zone 46. In this way the first stage carry-over gas is made to substantially bypass first stage intake zone 44.

The inlet to aperture 150 is preferably located axially where rotor blades 40 are longest in the radial direction. This is where the carry-over gas tends to accumulate in the rotor. In a particularly preferred embodiment, the inlet to aperture 150 is located angularly opposite the point at which the tips of blades 40 are closest to first stage housing portion 22. Axially, the inlet to aperture 150 begins very close to the small end of port member 50 and extends approximately one half the axial length of the opening between any two adjacent blades 40 (at the surface of port member 50). Angularly, the inlet to aperture 150 extends approximately one quarter the angular width of the opening between any two adjacent blades 40 (at the surface of port member 50).

The outlet of aperture 152 is preferably located angularly 180° plus the angular spacing between the centers of any two adjacent rotor blades 40 from the inlet of aperture 150 in the direction of rotor rotation. If the angular spacing between rotor blades 40 is approximately 20°, then the outlet of aperture 152 is preferably approximately 200° from the inlet of aperture 150 in the direction of rotor rotation. The axial location of the outlet of aperture 152 appears to be less critical than the axial location of the inlet of aperture 150. In a particularly preferred embodiment, the axial locations of the outlet of aperture 152 and the inlet of aperture 150 are the same. Aperture 152 is preferably substantially larger than aperture 150. In a preferred embodiment this is achieved by approximately doubling the angular width of aperture 152 as compared to aperture 150, while keeping the axial length of both apertures the same. This promotes flow in the desired direction, i.e., from aperture 150 through clearance 48 and aperture 152.

Figure 6:
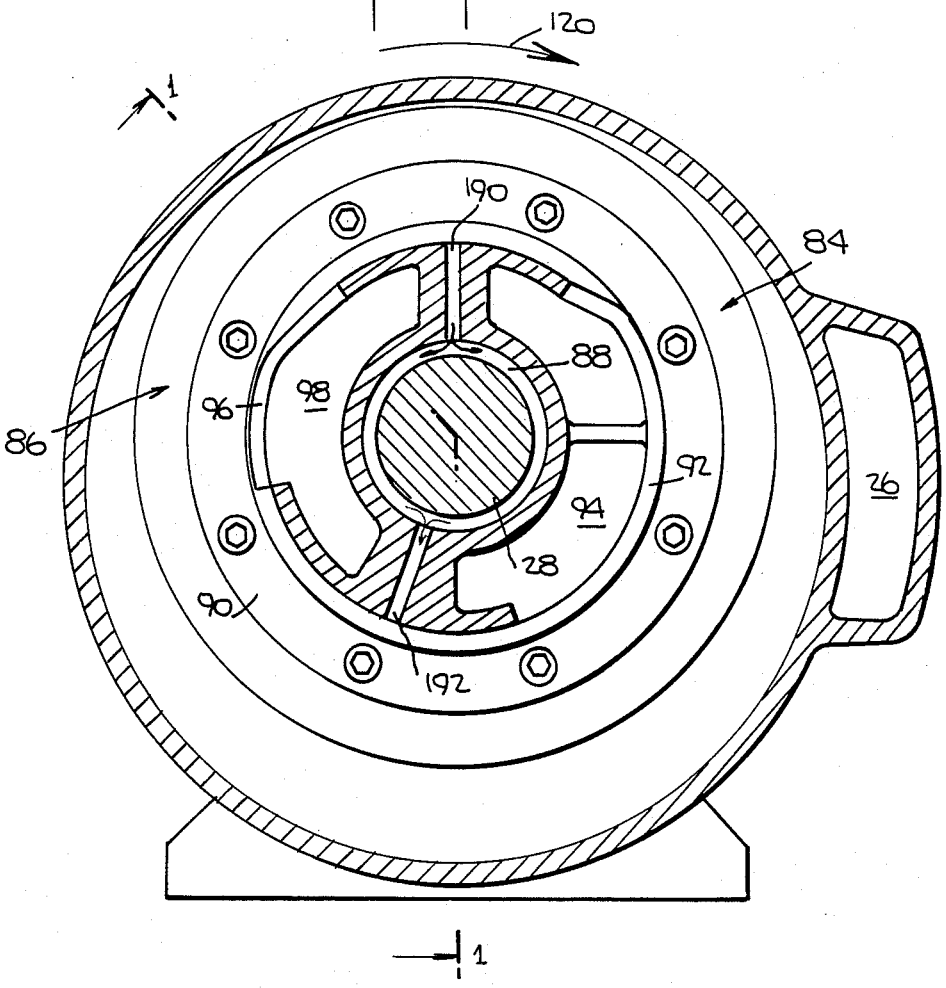
FIG. 6 is a cross-sectional view taken along the line 6—6 in FIG. 1 with the rotor removed.

If desired, carry-over gas in second stage 14 can be handled in a manner similar to the manner in which the first stage carry-over gas is handled. As is best seen in FIG. 6, second stage port member aperture 190 (structurally and functionally similar to aperture 150) allows gas that would otherwise be carried over from second stage compression zone 86 to second stage intake zone 84 to instead enter annular clearance 88 (structurally and functionally similar to clearance 48). From clearance 88 this gas flows through second stage port member aperture 192 (structually and functionally similar to aperture 152), thereby re-entering second stage rotor portion 38 downstream of intake zone 84. The sizes and locations of apertures 190 and 192 can be determined in relation to the components of second stage 14 in the same manner (described in detail above) that the sizes and locations of apertures 150 and 152 are determined in relation to the components of first stage 12.

It will be apparent from the foregoing that this invention reduces the energy waste associated with allowing carry-over gas to freely expand to the intake pressure of the pump stage or stages to which the invention is applied. The invention also increases the volumetric capacity of the pump, and allows the pump to achieve higher compression ratios than would otherwise be attainable. If the pump is a vacuum pump, this last feature means that the pump can provide higher vacuums than would otherwise be possible.

It has also been found that this invention allows the pump to operate satisfactorily with a smaller flow of fresh or fresh or recycled pumping liquid. The invention has also been found to increase the operational stability of the pump at lower rotor speeds over the entire compression ratio operating range of the pump.

Figure 8:
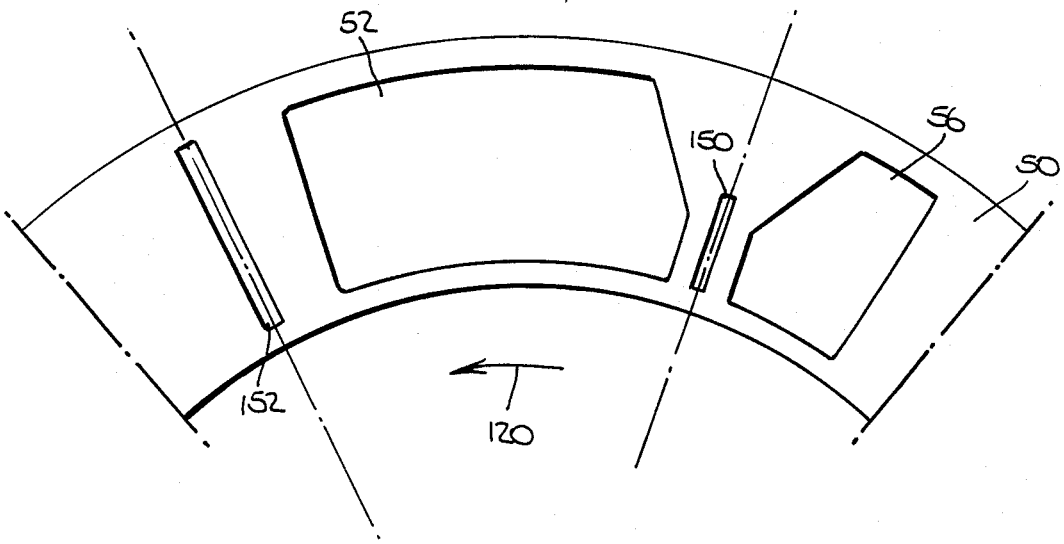
FIG. 8 is a view similar to FIG. 5 for the embodiment of FIG. 7.
Figure 7:
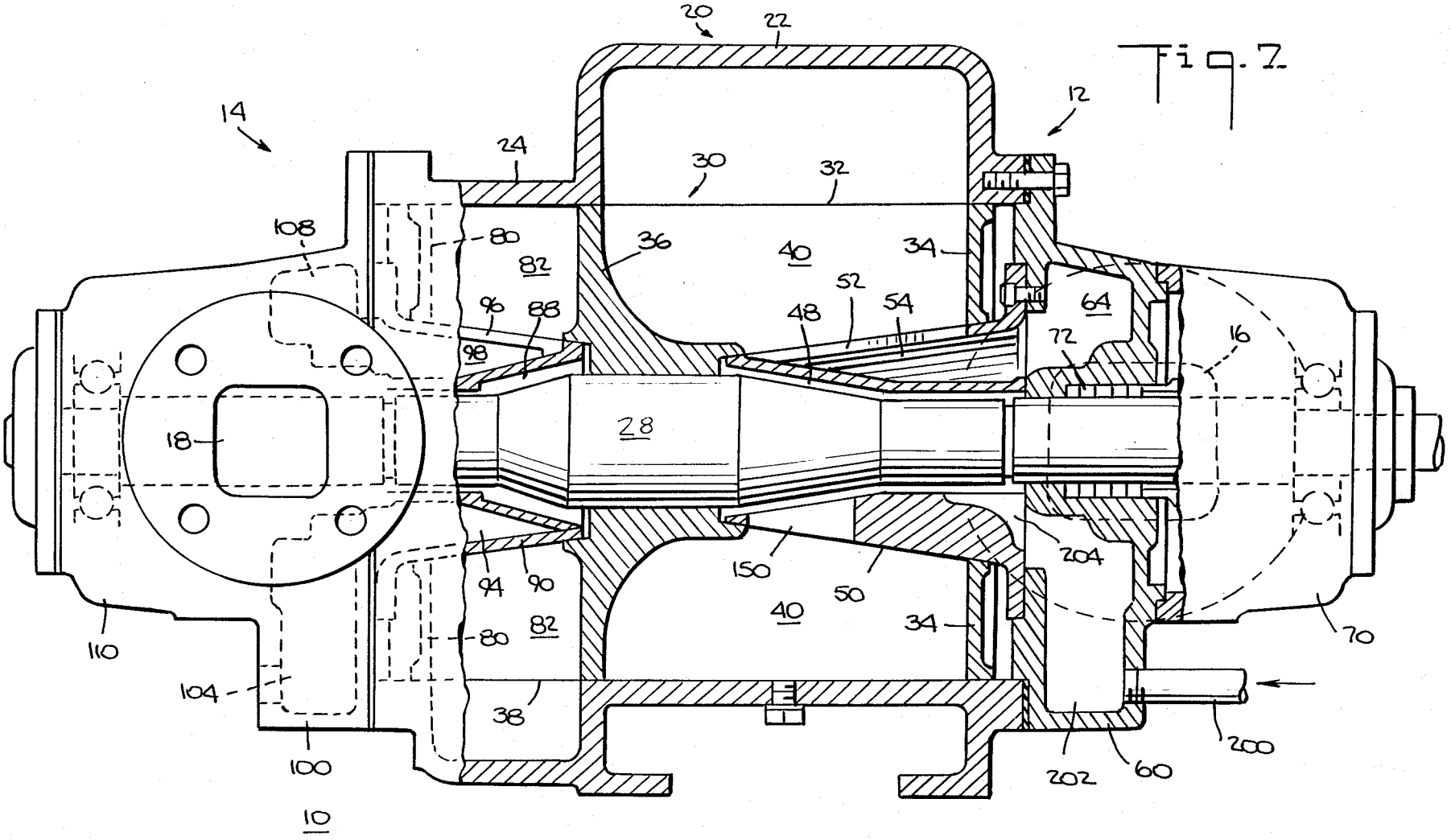
FIG. 7 is a view similar to FIG. 1 showing an alternative embodiment of the invention.

If desired, the conventional make-up flow of pumping liquid can be supplied to clearance 48 from outside the pump via conduit 200 as shown, for example, in FIG. 7. This pumping liquid enters chamber 202 in head member 60, and then flows into clearance 48 via passageway 204 in port member 50. From clearance 48 this liquid flows into rotor 30 via aperture 152, which may be enlarged as shown in FIG. 8 to accommodate the flow of pumping liquid in addition to the carry-over gas flow described above. No separate make-up liquid inlet port is required in port member 50. Additional advantages of this arrangement are (1) the flow of carry-over gas through clearance 48 and aperture 152 tends to introduce gas into the pumping liquid which may reduce the adverse effects of cavitation in the pump, and (2) pressurized pumping liquid is applied to stuffing assembly 72 from clearance 48, thereby improving the operation of the stuffing assembly. The pressurized carry-over gas is the source of the pressure which produces the second of these advantages. Alternatively, or in addition, make-up pumping liquid can be supplied to second stage clearance 88 for introduction into rotor 30 via aperture 192 in a manner similar to that described above for aperture 152.

Although the invention has been illustrated in its application to conically ported liquid ring pumps, those skilled in the art will appreciate that it is equally applicable to cylindrically ported pumps of the type shown, for example, in Dardelet U.S. Pat. No. 2,344,396. For present purposes, the only difference between conically ported and cylindrically ported liquid ring pumps is that in the latter the port member (equivalent to depicted port member 50 or 90) is cylindrical rather than tapered. The basic structure of this invention is therefore directly applicable to cylindrically ported liquid ring pumps.

Figure 9:
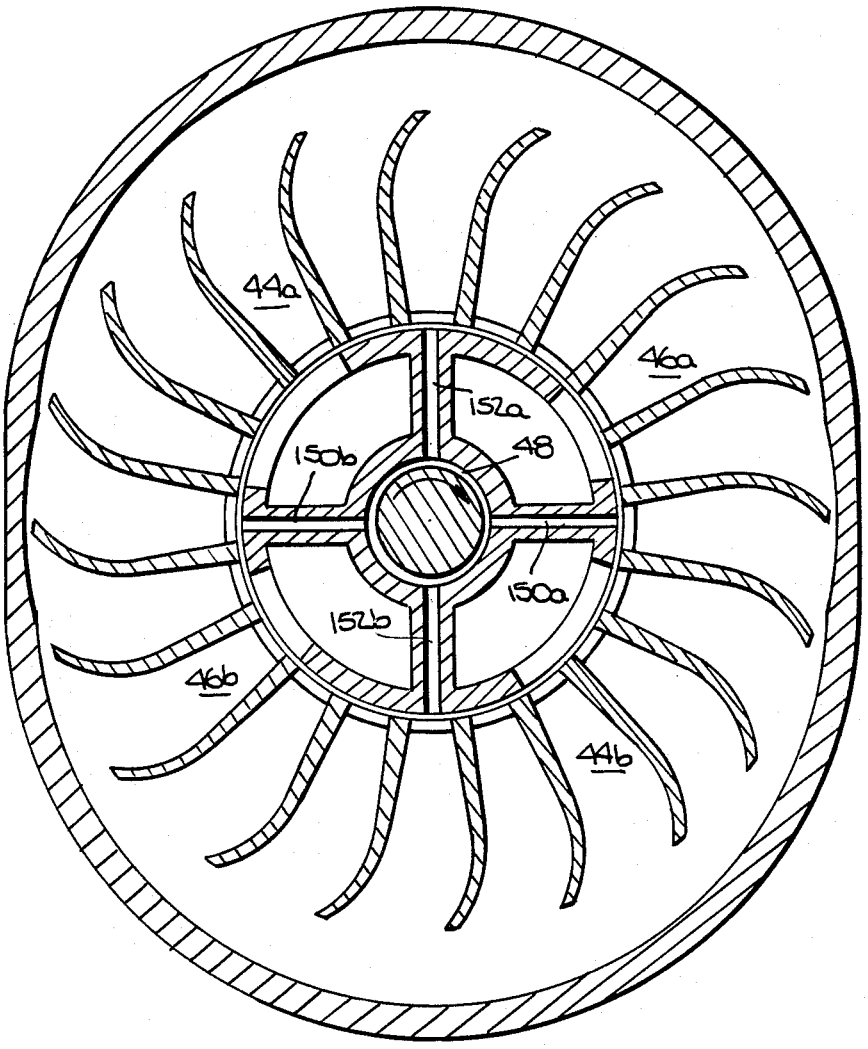
FIG. 9 is a view similar to FIG. 2 showing another alternative embodiment of the invention.

This invention is also applicable to conically or cylindrically ported liquid ring pumps having two or more intake and compression cycles per revolution (see FIG. 9, which illustrates a pump having two intake and compression cycles per revolution). In such pumps, the gas that would otherwise be carried over from each compression zone 46*a* or 46*b* to the start of the next intake zone 44*b* or 44*a* is admitted to clearance 48 via a port member aperture 150*a* or 150*b*. The gas in clearance 48 is discharged to the start of both compression zones via port member apertures 152*a* and 152*b*.

The invention is not limited in its application to two-stage pumps such as the ones shown in the drawings. It is also applicable to single-stage pumps such as could be constructed by omitting second stage 14 in the depicted pumps. It is also applicable to pumps having two or more single-stage sections as shown, for example, in Jennings U.S. Pat. No. 3,154,240. In such pumps, each section can be constructed similarly to either stage in the pumps depicted herein in order to achieve the advantages of this invention.

We claim:

1. A liquid ring pump comprising:

an annular housing;

a shaft rotatably mounted in the housing;

an annular rotor mounted concentrically on the shaft in the housing for rotation with the shaft, the rotor having a plurality of angularly spaced blades extending radially outward from the shaft, at least one concentric axial end portion of the rotor being radially spaced from the shaft to define an annular space between that portion of the rotor and the shaft;

an annular port member surrounding the shaft and extending into the annular space, the inner surface of the port member being radially spaced from the shaft to provide a clearance between the port member and the shaft;

an intake port through the outer surface of the port member for admitting gas to be pumped to an intake zone of the pump;

a discharge port through the outer surface of the port member for discharging compressed gas from a compression zone of the pump;

a first aperture extending substantially radially through the port member from a first location on the outer surface of the port member after the discharge port but before the intake port in the direction of rotor rotation to the clearance for conveying compressed gas not discharged via the discharge port through the first aperture from the first location to the clearance; and a second aperture extending substantially radially through the port member from the clearance to a second location on the outer surface of the port member after the intake port but before the discharge port in the direction of rotor rotation for conveying the gas introduced into the clearance via the first aperture from the clearance to the compression zone at the second location without passing through the intake zone.

2. The apparatus defined in claim 1 wherein the cross sectional area of the second aperture is greater than the cross sectional area of the first aperture.

3. The apparatus defined in claim 1 wherein the clearance extends annularly around the shaft.

4. The apparatus defined in claim 1 wherein the outer surface of the port member is frusto-conical and wherein the first aperture passes through the smaller circumference portion of the port member outer surface.

5. The apparatus defined in claim 1 wherein the inlet to the first aperture is a first axially extending slot in the outer surface of the port member, the width of the first slot being less than the angular spacing between any two adjacent blades at the location of the first slot.

6. The apparatus defined in claim 5 wherein the width of the first slot is approximately one quarter of the angular spacing between any two adjacent blades at the location of the first slot.

7. The apparatus defined in claim 5 wherein the outlet of the second aperture is a second axially ectending slot in the outer surface of the port member, the width of the second slot being less than the angular spacing between any two adjacent blades at the location of the second slot and greater than the width of the first slot.

8. The apparatus defined in claim 7 wherein the width of the first slot is approximately one quarter of the angular spacing between any two adjacent blades at the location of the first slot, and wherein the width of the second slot is approximately one half of the angular spacing between any two adjacent blades at the location of the second slot.

9. The apparatus defined in claim 1 wherein the outlet of the second aperture is a second axially extending slot in the outer surface of the port member, the width of the second slot being less than the angular spacing between any two adjacent blades at the location of the second slot.

10. The apparatus defined in claim 9 wherein the width of the second slot is approximately one half of the angular spacing between any two adjacent blades at the location of the second slot.

11. The apparatus defined in claim 1 wherein the inlet to the first apertures is located in the portion of the outer surface of the port member intersected by a first radial axis which intersects the location at which the outer circumference of the rotor is closest to the housing.

12. The appartus defined in claim 1 wherein the outlet of the second aperture is located in the portion of the outer surface of the port member intersected by a second radial axis which is beyond, in the direction of rotor rotation, a third radial axis which intersects the location at which the outer circumference of the rotor is most distant from the housing.

13. The appartus defined in claim 12 wherein the angular spacing between the second and third radial axes is approximately equal to the angular spacing between the centers of any two adjacent blades.

14. The apparatus defined in claim 1 further comprising:

means for supplying pumping liquid to the clearance so that the pumping liquid enters the liquid ring via the second aperture.

15. The apparatus defined in claim 1 wherein both concentric axial end portion of the rotor are radially spaced from the shaft to define respective first and second annular spaces between those portions of the rotor and the shaft, wherein the first annular space is the one in which the annular port member is disposed, and wherein the apparatus further comprises:

a second annular port member surrounding the shaft and extending into the second annular space, the inner surface of the port member being radially spaced from the shaft to provide a second clearance between the second port member and the shaft;

a second intake port through the outer surface of the second port member for admitting gas to be pumped to a second intake zone of the pump;

a second discharge port through the outer surface of the second port member for discharging compressed gas from a second compression zone of the pump;

a third aperture extending substantially radially through the second port member from a third location on the outer surface of the second port member after the second discharge port but before the second intake port in the direction or rotor rotation to the second clearance for conveying compressed gas not discharged via the second discharge port through the third aperture from the third location to the second clearance; and a fourth aperture extending substantially radially through the second port member from the second clearance to a fourth location on the outer surface of the second port member after the second intake port but before the second discharge port in the direction of rotor rotation for conveying gas introduced into the second clearance via the third aperture from the second clearance to the second compression zone at the fourth location without passing through the second intake zone.

16. The apparatus defined in claim 15 wherein the clearance and the second clearance are isolated from one another by an intermediate annular portion of the rotor which is in annular contact with the shaft.

17. The apparatus defined in claim 15 wherein the pump is a two-stage pump and wherein the discharge port is connected to the second intake port.

18. The apparatus defined in claim 15 wherein the rotor includes an annular shroud extending radially outward from the shaft to the inner surface of the housing intermediate the port member and the second port member for isolating the intake and compression zones from the second intake and second compression zones.

19. The apparatus defined in claim 1 further comprising:

a second intake port through the outer surface of the port member beyond the first aperture in the direction of rotor rotation for admitting gas to be pumped to a second intake zone of the pump;

a second discharge port through the outer surface of the port member beyond the second intake port but before the intake port in the direction of rotor rotation for discharging compressed gas from a second compression zone of the pump; and a third aperture extending substantially radially through the port member from a third location on the outer surface of the port member after the second discharge port but before the intake port in the direction of rotor rotation to the clearance for conveying compressed gas not discharged via the second discharge port through the third aperture from the third location to the clearance.

20. The apparatus defined in claim 19 further comprising:

a fourth aperture extending substantially radially through the port member from the clearance to a fourth location on the outer surface of the port member after the second intake port but before the second discharge port in the direction of rotor rotation for conveying gas introduced into the clearance via either of the first and third apertures from the clearance into the second compression zone at the fourth location without passing through the second intake zone.

* * * * *